US011624229B2

(12) United States Patent
Morosawa et al.

(10) Patent No.: US 11,624,229 B2
(45) Date of Patent: Apr. 11, 2023

(54) VEHICLE CONTROL DEVICE AND METHOD OF OPERATING AN OPENING AND CLOSING BODY

(71) Applicant: HONDA MOTOR CO., LTD., Tokyo (JP)

(72) Inventors: Ryo Morosawa, Wako (JP); Katsuyasu Yamane, Wako (JP); Haisong Liu, Wako (JP); Seonghun Lee, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 218 days.

(21) Appl. No.: 17/147,932

(22) Filed: Jan. 13, 2021

(65) Prior Publication Data

US 2021/0214990 A1 Jul. 15, 2021

(30) Foreign Application Priority Data

Jan. 15, 2020 (JP) ..... JP2020-004225

(51) Int. Cl.
*E05F 15/00* (2015.01)
*E05F 15/73* (2015.01)
(Continued)

(52) U.S. Cl.
CPC ..... *E05F 15/73* (2015.01); *E05B 81/16* (2013.01); *E05B 81/78* (2013.01); *E05B 83/40* (2013.01);
(Continued)

(58) Field of Classification Search
CPC ..... E05F 15/73; E05F 2015/767; E05Y 2201/422; E05Y 2900/532; E05B 81/16; E05B 81/78; E05B 83/40
(Continued)

(56) References Cited

U.S. PATENT DOCUMENTS 7,175,227 B2 * 2/2007 Menard ..... E05F 15/43 296/146.4
10,323,452 B2 * 6/2019 Kwak ..... G07C 9/00309
(Continued)

FOREIGN PATENT DOCUMENTS

CN 105599724 A 5/2016
JP 2003-138817 A 5/2003

OTHER PUBLICATIONS

Office Action dated Dec. 3, 2021 issued over the corresponding Chinese Patent Application No. 202110052877.5 with an English translation of the pertinent portion.

*Primary Examiner* — Chi Q Nguyen
(74) *Attorney, Agent, or Firm* — Carrier Shende & Associates, P.C.; Fulchand P. Shende; Joseph P. Carrier

(57) ABSTRACT

A vehicle control device includes image capturing units, control equipment that extracts at least one living body from image information captured by the image capturing units and performs processing, and a door operating system capable of unlocking the doors of a vehicle and executing an opening operation for the doors. When a user of the vehicle is included among a plurality of the extracted living bodies and it is estimated that a predetermined type of living body is in contact with the user, the control equipment causes the doors to be operated in a first mode. When the user is included among the plurality of the extracted living bodies and it is estimated that the predetermined type of living body is not in contact with the user, the control equipment causes the doors to be operated in a second mode that differs from the first mode.

10 Claims, 9 Drawing Sheets

(51) Int. Cl.
*E05B 81/16* (2014.01)
*E05B 83/40* (2014.01)
*E05B 81/78* (2014.01)

(52) U.S. Cl.
CPC ... *E05F 2015/767* (2015.01); *E05Y 2201/422* (2013.01); *E05Y 2900/532* (2013.01)

(58) Field of Classification Search
USPC ..... 49/31
See application file for complete search history.

(56) References Cited

U.S. PATENT DOCUMENTS

| | | | | |
|---|---|---|---|---|
| 10,465,429 | B2 | 11/2019 | Koiso | |
| 2011/0295469 | A1* | 12/2011 | Rafii | E05F 15/43 701/49 |
| 2016/0012654 | A1* | 1/2016 | Sherony | G07C 9/257 340/5.72 |
| 2018/0023334 | A1* | 1/2018 | Kwak | E05F 15/76 49/31 |
| 2020/0256442 | A1* | 8/2020 | Mellet | F16D 25/0638 |
| 2021/0213957 | A1* | 7/2021 | Brown | G01C 21/3438 |
| 2021/0293074 | A1* | 9/2021 | Morosawa | E05F 15/73 |
| 2021/0370866 | A1* | 12/2021 | Morosawa | B60R 25/31 |
| 2022/0074242 | A1* | 3/2022 | Kim | E05B 83/36 |
| 2022/0219643 | A1* | 7/2022 | Hanson | B60R 25/25 |

* cited by examiner

FIG. 6

70a

| | DRIVER'S SEAT DOOR | PASSENGER SEAT DOOR | REAR SEAT DOOR ON SIDE WHERE IMAGE OF USER IS CAPTURED | REAR SEAT DOOR ON SIDE OPPOSITE FROM SIDE WHERE IMAGE OF USER IS CAPTURED |
|---|---|---|---|---|
| NO USER CONFIRMATION | LOCK | LOCK | LOCK | LOCK |
| ONLY USER EXISTS | UNLOCK + OPEN | UNLOCK | UNLOCK | UNLOCK |
| USER AND CHILD ARE HOLDING HANDS (LIVING BODY IN CONTACT WITH USER EXISTS) | UNLOCK + OPEN | UNLOCK | UNLOCK + OPEN | UNLOCK |
| USER AND CHILD ARE NOT HOLDING HANDS (LIVING BODY NOT IN CONTACT WITH USER EXISTS) | UNLOCK + OPEN | UNLOCK | UNLOCK | UNLOCK |

VEHICLE CONTROL DEVICE AND METHOD OF OPERATING AN OPENING AND CLOSING BODY

CROSS-REFERENCE TO RELATED APPLICATION

This application is based upon and claims the benefit of priority from Japanese Patent Application No. 2020-004225 filed on Jan. 15, 2020, the contents of which are incorporated herein by reference.

BACKGROUND OF THE INVENTION

Field of the Invention

The present invention relates to a vehicle control device and a method of operating an opening and closing body for unlocking, and further automatically opening an opening and closing body of a vehicle from a locked state.

Description of the Related Art

Certain vehicles such as four-wheeled automotive vehicles are configured to capture images of a user outside of a vehicle in a stopped state, and unlock an opening and closing body such as a door or the like by performing user authentication based on the captured image information. For example, in Japanese Laid-Open Patent Publication No. 2003-138817, a keyless entry system is disclosed in which iris data of a user is extracted from captured image information captured by a vehicle periphery monitoring device (image capturing unit), and user authentication is carried out on the basis of the iris data.

Incidentally, vehicles may be configured to automatically perform not only unlocking of an opening and closing body, but also an opening operation of the opening and closing body. In particular, in the case that a plurality of passengers (a spouse, children, etc.) are recognized in addition to the user, the vehicle automatically opens doors other than the driver's door, which further enhances convenience at the time of boarding.

SUMMARY OF THE INVENTION

However, in the case that the doors (opening and closing bodies) of the vehicle are configured to open automatically, for example, a child who is unaware of the specifications may assume that the doors are ones that will open automatically, and may run to the doors in order to board the vehicle. At this time, there is a possibility that the child will collide with the doors, either because the doors are in the process of opening, or because the doors suddenly open, or alternatively, due to the fact that authentication of the user has not been established yet. Further, the child may come too close in proximity to the doors, leading to a concern that opening of the doors may be hindered.

The present invention has been devised taking into consideration the aforementioned problems, and has the object of providing a vehicle control device and a method of operating an opening and closing body, in which both convenience and safety can be ensured at a time of boarding, by estimating contact between a user of the vehicle and a predetermined living body, and operating the opening and closing body in an appropriate mode based on the captured image information.

In order to achieve the above-described object, a first aspect of the present invention is characterized by a vehicle control device, including an image capturing unit provided in a vehicle and configured to capture an image of an external environment of the vehicle, a control unit configured to extract at least one living body from image information captured by the image capturing unit and perform processing, and an opening and closing body operating unit configured to, under the control of the control unit, switch an opening and closing body of the vehicle from a locked state to an unlocked state and execute an opening operation of the opening and closing body, wherein the control unit includes a type identification unit configured to identify a type of the living body that was extracted, and the control unit, in the case that a user of the vehicle is included among a plurality of the living bodies that were extracted, and it is estimated that a predetermined type of living body that was identified by the type identification unit is in contact with the user, causes the opening and closing body to be operated in a first mode, and, in the case that the user is included among the plurality of living bodies that were extracted, and it is estimated that the predetermined type of living body that was identified by the type identification unit is not in contact with the user, causes the opening and closing body to be operated in a second mode that differs from the first mode.

Further, in order to achieve the above-described object, a second aspect of the present invention is characterized by a method of operating an opening and closing body by a vehicle control device, the vehicle control device including an image capturing unit provided in a vehicle and configured to capture an image of an external environment of the vehicle, a control unit configured to extract at least one living body from image information captured by the image capturing unit and perform processing, and an opening and closing body operating unit configured to, under the control of the control unit, switch an opening and closing body of the vehicle from a locked state to an unlocked state and execute an opening operation of the opening and closing body, the method including: authenticating a user of the vehicle by the control unit; unlocking the opening and closing body by the opening and closing body operating unit in the case that the user is authenticated; estimating contact between the user and a predetermined type of living body by the control unit, based on image information captured by the image capturing unit; and causing the opening and closing body operating unit to open the unlocked opening and closing body in the case it is estimated that the user and the predetermined type of living body are in contact with each other.

In the above-described vehicle control device and the method of operating the opening and closing body, both convenience and safety can be ensured at a time of boarding, by estimating contact between the user of the vehicle and the predetermined living body, and operating the opening and closing body in an appropriate mode based on the captured image information.

The above and other objects, features, and advantages of the present invention will become more apparent from the following description when taken in conjunction with the accompanying drawings, in which preferred embodiments of the present invention are shown by way of illustrative example.

BRIEF DESCRIPTION OF THE DRAWINGS

FIG. 6 is a correspondence table showing an example of map information of each of respective door modes based on a contact or non-contact state between the user and the child;

DETAILED DESCRIPTION OF THE PREFERRED EMBODIMENTS

Hereinafter, preferred embodiments of the present invention will be presented and described in detail below with reference to the accompanying drawings.

First Embodiment

Figure 1:
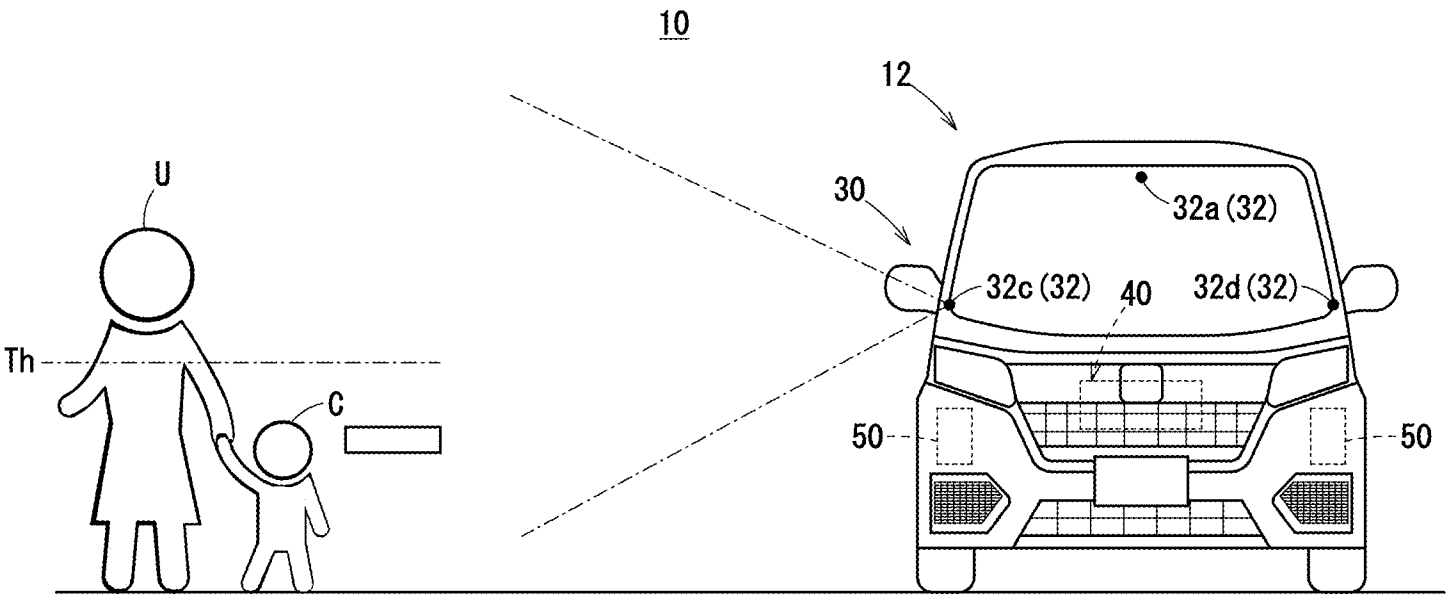
FIG. 1 is an explanatory diagram showing an example in which an image is captured of a state in which a user and a child are holding hands, in relation to a vehicle control device according to a first embodiment of the present invention.
Figure 2:
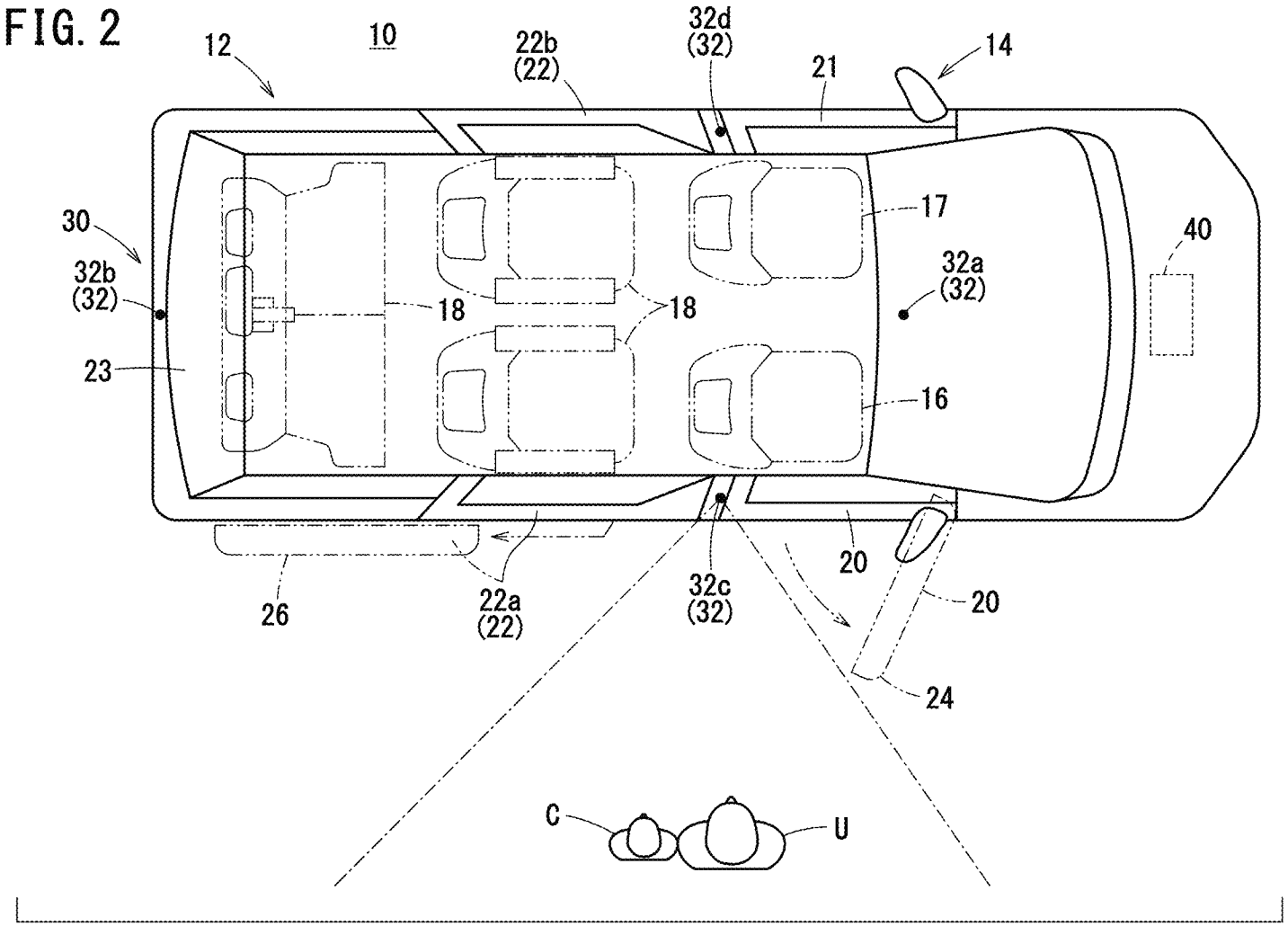
FIG. 2 is a plan view of a user, a child, and a vehicle in which the vehicle control unit is provided.

As shown in FIGS. 1 and 2, a vehicle control device 10 according to a first embodiment of the present invention is installed in a vehicle 12 such as a four-wheeled automotive vehicle, and controls operations of a plurality of doors 14 (opening and closing bodies) provided on the vehicle 12. Operations of the doors 14 that are controlled by the vehicle control device 10 include a locking and unlocking operation of locking and unlocking the doors 14, and an opening and closing operation of opening and closing the doors 14.

As shown in FIG. 2, the doors 14 of a right-hand steering wheel vehicle 12 include a driver's seat door 20 adjacent to a driver's seat 16, a passenger seat door 21 adjacent to a passenger seat 17, rear seat doors 22 adjacent to rear seats 18, and a back door 23 provided on a rear side of the vehicle 12. The rear seat doors 22 are provided as a pair on both sides in a lateral (widthwise) direction of the vehicle 12, and are constituted by a right rear seat door 22*a* and a left rear seat door 22*b*. The vehicle control device 10 is configured so as to individually control the locking and unlocking operation and the opening and closing operation of each of the doors 14. Moreover, in the case of a left-hand steering wheel vehicle 12, it goes without saying that the left-hand and right-hand positions of the driver's seat door 20 and the passenger seat door 21 are reversed.

Further, the vehicle 12 according to the present embodiment employs hinged doors 24 that open and close via non-illustrated hinge portions serving as fulcrums on the driver's seat door 20 and the passenger seat door 21. On the other hand, the vehicle 12 employs sliding doors 26 that slide rearward when the right rear seat door 22*a* and the left rear seat door 22*b* are opened. Of course, the opening and closing method for each of the doors 14 is not particularly limited, and for example, the left rear seat door 22*b* and the right rear seat door 22*a* may also be hinged doors 24.

In addition, the vehicle control device 10 which is installed in the vehicle 12 operates the doors 14 based on captured image information of image capturing units 30. For the image capturing units 30, in order to provide assistance in avoiding obstacles when the vehicle 12 is traveling, image capturing units 30 that capture images of the external environment around the vehicle 12 can be used (i.e., a well-known configuration for the image capturing units 30 can be used). The image capturing units 30 capture images in a longitudinal (front-rear) direction (on both sides in the vehicle lengthwise direction: frontward and rearward) of the vehicle 12, and the left and right directions (on both sides in the vehicle widthwise direction) of the vehicle 12. For this purpose, the image capturing units 30 are provided with external environment sensors 32 constituted by at least one of cameras, radar devices, or the like provided on each of the four sides (front, rear, left, and right) of the vehicle 12. The external environment sensors 32 capture images of the external environment around the vehicle 12 in accordance with respective characteristics, and output captured image information to control equipment 40 (control unit: electronic control unit (ECU)) inside the vehicle 12. It should be noted that the external environment sensors 32 may be constituted by one type of device, or other devices may be applied thereto. As examples of such other devices, there may be cited infrared sensors, ultrasonic sensors, LIDAR devices (photodetectors), and the like.

For example, a front external environment sensor 32*a* that captures images of the front of the vehicle 12 is installed on an inner side of the front window (inside the vehicle compartment interior). A rear external environment sensor 32*b* that captures images of the rear of the vehicle 12 is installed at an appropriate position on the back door 23. A right external environment sensor 32*c* that captures images of the right side of the vehicle 12 is installed on a right side structural portion (a right center pillar, a right side mirror, etc.) of the vehicle body. Similarly, a left external environment sensor 32*d* that captures images of the left side of the vehicle 12 is installed on a left side structural portion (a left center pillar, a left side mirror, etc.) of the vehicle body.

The image capturing units 30 are driven at a low power even in a stopped state (standby state) of the vehicle 12, and images of the external environment are captured under the control of the control equipment 40 which is installed in the vehicle 12. In addition, the control equipment 40 subjects the captured image information received from the image capturing units 30 to image processing, and thereby extracts at least one living body included in the captured image information. Furthermore, when the control equipment 40 recognizes that the user U of the vehicle 12 is included among the extracted living bodies (performs user authentication), the control equipment 40 controls the doors 14 of the vehicle 12 in appropriate modes.

Figure 3:
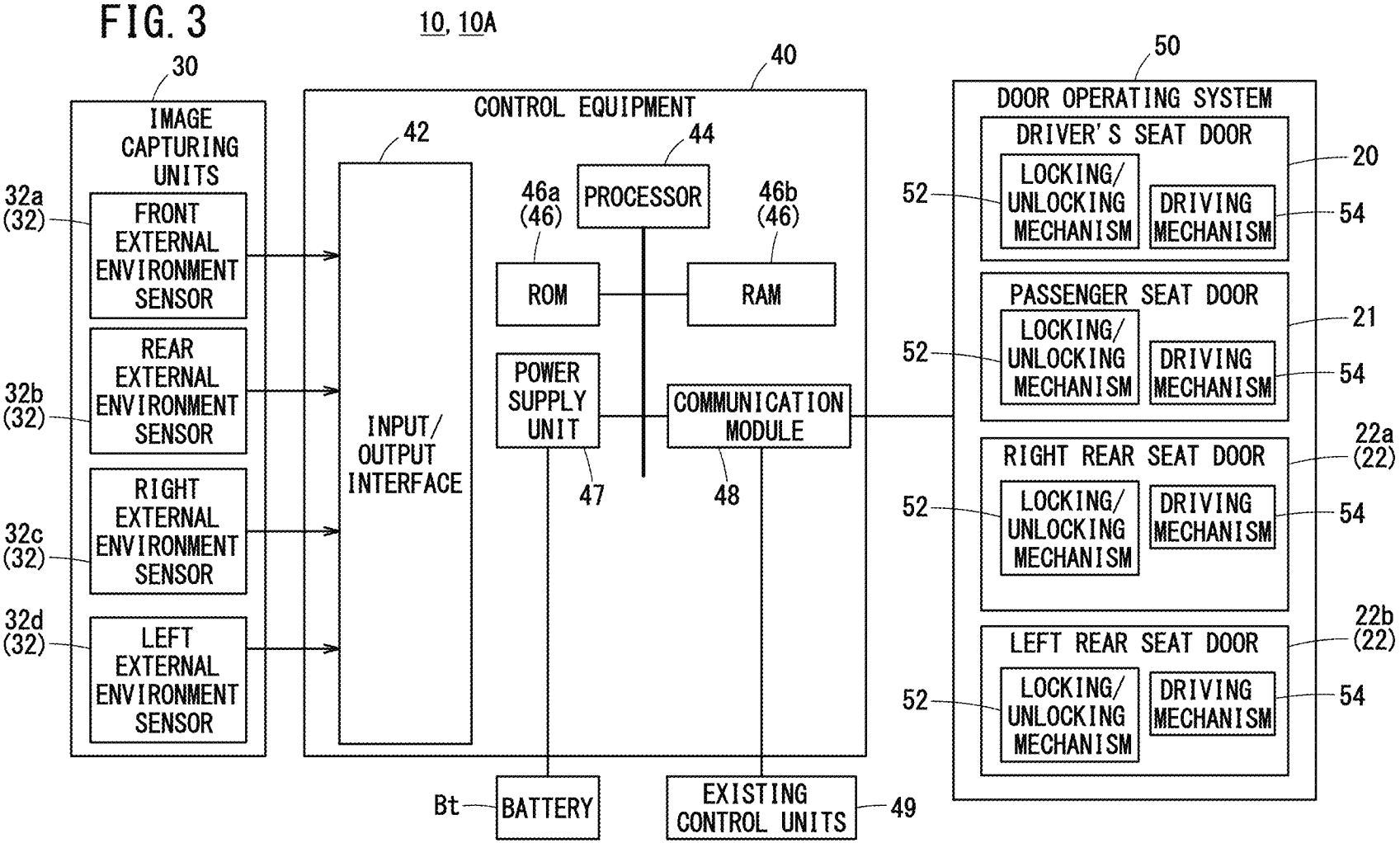
FIG. 3 is a block diagram showing a hardware configuration of a vehicle control device.

More specifically, as shown in FIG. 3, the vehicle control device 10 is equipped with a door operating system 50 (opening and closing body operating unit) inside the vehicle 12, in addition to the image capturing units 30 and the control equipment 40. The door operating system 50 includes a function of executing a locking and unlocking operation and an opening and closing operation for each of the doors 14 of the vehicle 12 on the basis of control commands from the control equipment 40.

The control equipment 40 is configured in the form of a computer having an input/output interface 42, a processor 44, and memories 46 (a ROM 46*a* (Read Only Memory) and a RAM 46*b* (Random Access Memory)). The control equipment 40 constitutes a software-based control means for controlling the vehicle 12, by the processor 44 executing and processing non-illustrated programs stored in the ROM 46*a*. Furthermore, the control equipment 40 has a power supply unit 47 that supplies electrical power from a battery Bt of the vehicle 12, together with supplying the electrical power to each of the components of the control equipment 40, and a communication module 48 for carrying out communications with other vehicle-mounted equipment (existing control units 49) inside the vehicle 12.

On the other hand, the door operating system 50 includes locking/unlocking (locking and unlocking) mechanisms 52 for locking and unlocking the doors 14, and driving mechanisms 54 for opening and closing the doors 14, which are provided for each of the driver's seat door 20, the passenger seat door 21, the right rear seat door 22*a*, and the left rear seat door 22*b*.

The locking/unlocking mechanisms 52 are equipped respectively with non-illustrated locking/unlocking movable bodies, and non-illustrated advancing and retracting operating mechanisms for advancing and retracting the locking/unlocking movable bodies between a locked position and an unlocked position. In the case that the locking/unlocking movable bodies are in the locked position, the doors 14 are locked, and the closed state of the doors 14 is continued even if the user U pulls on the door knobs in order to open the doors 14, for example. On the other hand, in the case that the locking/unlocking movable bodies are in the unlocked position, the doors 14 are placed in an unlocked state in which opening is permitted, and the doors 14 can be opened when the user U pulls on the door knobs.

The driving mechanisms 54 are equipped with non-illustrated door motors, and non-illustrated power transmission units that appropriately convert and transmit the power of the door motors to perform the opening operation and the closing operation for the doors 14. The power transmission units have an appropriate structure depending on the opening and closing method for the doors 14. Further, when a command is received to open the doors 14, the door operating system 50 operates the driving mechanisms 54 and performs the opening operation for the doors 14, after having confirmed the unlocked state of the locking/unlocking mechanisms 52.

Next, a description will be given with reference to FIG. 4 concerning operations (software) of the control equipment 40 in the vehicle control device 10 having the above-described hardware configuration. More specifically, the control equipment 40 constitutes a functional unit which is made up from an image processing unit 60 (image recognition engine) for image processing, and a door control unit 80 for controlling operations of the doors 14 of the vehicle 12 under the execution of programs. Moreover, the door control unit 80 may be provided in a device apart from the image processing unit 60 (for example, in a non-illustrated control device of the door operating system 50).

The image processing unit 60 extracts objects from the captured image information, and determines modes for each of the doors 14 of the vehicle 12 based on information of the living bodies contained within the extracted objects. A captured image information processing unit 62, an object extraction unit 64, an extracted information processing unit 66, a relationship estimation unit 68, and a mode determination processing unit 70 are formed in the interior of the image processing unit 60.

The captured image information processing unit 62 temporarily stores in the RAM 46*b* the captured image information acquired from the image capturing units 30, and modifies, corrects, and integrates the captured image information (for example, two types of images which are captured in the same direction are combined into one image), and performs image processing on information in which objects can sufficiently be extracted. Concerning correction of the images, well-known processing methods such as hue correction, sharpness correction, luminance correction, and brightness correction can be applied thereto, and the captured image information processing unit 62 performs appropriate corrections based on the performance of the external environment sensors 32, the state of the environment in which the image capturing units 30 capture images, and the like. Further, as has been noted above, the image capturing units 30 are configured to include the external environment sensors 32 on the four sides of the vehicle 12, and the captured image information processing unit 62 carries out image processing while associating the captured image information of the respective external environment sensors 32 with the imaging directions of the vehicle 12.

Concerning the captured image information output from the captured image information processing unit 62, the object extraction unit 64 extracts objects (dynamic objects and stationary objects) by way of a predetermined algorithm. As for the method of extracting objects from the captured image information, well-known processing methods may be adopted therefor, for example, in which feature amounts are calculated based on hue to thereby extract boundaries (shapes), differences from processed image information in the past are calculated, and the like.

When dynamic objects and stationary objects are individually extracted in relation to the captured image information on the four sides of the vehicle, the object extraction unit 64 outputs such information to the extracted information processing unit 66 in a state in which the imaging directions are associated with the dynamic objects and the stationary objects. Further, when a dynamic object is extracted from the captured image information that is captured over the passage of time, the object extraction unit 64 continues to track movements of the same dynamic object by measuring the feature amounts of the dynamic object.

The extracted information processing unit 66 performs various processes (identifying types of living bodies, performing user authentication, estimating a state of contact between the living bodies, etc.) based on the dynamic objects and the stationary objects that are extracted by the object extraction unit 64. For this purpose, a type identification unit 72, a user authentication unit 76, and a contact estimation unit 78 are constructed in the extracted information processing unit 66.

The type identification unit 72 estimates the type and the state of the extracted dynamic objects, such as adults, children, wheelchair users, animals (pets) such as dogs and cats, and the like. For example, in estimating the type of a dynamic object, the height of the dynamic object is calculated, and in the case that the height is greater than or equal to a predetermined height threshold value Th, the dynamic object is determined to be an adult, whereas in the case that the height is less than the predetermined height threshold value Th, the dynamic object is determined to be a child (see FIG. 1). Further, for example, the type identification unit 72 may determine whether the dynamic object is an adult or a child from facial feature amounts of the dynamic object. Concerning people and other animals, they can be identified (recognized) by the shape of the dynamic objects (including a relative size or the like), and similarly, wheelchair users and the like can be identified by differences in the shapes thereof.

The user authentication unit 76 carries out user authentication in order to determine whether or not the extracted dynamic object is a user U (a driver or another passenger) of the vehicle 12. In this instance, the vehicle control device 10 is formed with a configuration in which feature amounts of users U are stored, by registering in advance in the control equipment 40 faces, bodies (including skeleton figures) and the like of users U who use the vehicle 12. In addition, by way of user authentication, the feature amounts of the extracted dynamic objects are compared with the stored feature amounts of the users U, and in the case that such feature amounts coincide with each other, the extracted dynamic objects are identified as the users U of the vehicle 12, whereas in the case that the feature amounts do not coincide, the extracted dynamic objects are not identified as the users U of the vehicle 12.

The user authentication unit 76 applies markings to a person (dynamic objects) in the captured image information that was authenticated as being a user by the user authentication unit 76, and continuously captures the user U. During such capturing, the user authentication unit 76 carries out user authentication a plurality of times, and by confirming the user U in the case that the user U has been authenticated a predetermined number of times or more, it is possible to enhance security.

Needless to say, the vehicle control device 10 enables information concerning a plurality of users U to be registered for the purpose of user authentication, if there is a possibility that such persons may use the vehicle 12. For example, in the vehicle control device 10, in addition to a person for whom there is a possibility of driving the vehicle 12, persons who do not drive (persons for whom there is a possibility of boarding the passenger seat 17 or the rear seats 18) may be registered.

Further, concerning the user authentication performed by the user authentication unit 76, various methods can be adopted therefor. For example, the user authentication unit 76 may authenticate the user U in the case it is detected that the user U is making a registered type of gesture. The vehicle control device 10 is not limited to performing user authentication using the captured image information, and may be provided, for example, with a communication device (not shown) that implements wireless communications within a predetermined distance from the vehicle 12, and user identification information may be received by way of radio waves from a terminal possessed by the user U. Stated otherwise, by way of such user authentication, the user U is authenticated in the case that identifying information for authentication which is retained beforehand, and the received user authentication identification information coincide, whereas the user U is not authenticated in the case that they do not coincide. As examples of the terminal possessed by the user U, there may be cited a smartphone, a touch pad, an electronic key, an IC card, an RFID tag, a wearable computer, or another type of mobile information terminal. Further, the user authentication unit 76 may be configured in a manner to enhance security by carrying out a plurality of types of user authentication.

The contact estimation unit 78 is a functional unit that estimates contact between the plurality of living bodies themselves which are extracted by the object extraction unit 64. As examples of contact between a plurality of living bodies, there may be cited situations in which the hands are held, when a hand of one of the living bodies is in contact with a hand of another living body, when pushing a wheelchair or a stroller, when hugging, or in the case of a pet, when the pet is held via a leash. More specifically, contact between the plurality of living bodies includes a case in which the bodies are in direct contact with each other, and a case in which the bodies are in contact with each other via a tool or device.

Concerning the contact estimation method, various methods may be adopted therefor. For example, as such a method, there may be cited a method of forming skeleton figures of the living bodies (dynamic objects) based on the captured image information, and determining a state of contact between the skeleton figures of the plurality of living bodies. For this purpose, the contact estimation unit 78 includes a skeleton figure generating unit 78*a* configured to construct schematic skeleton figures (hereinafter, referred to as schematic skeleton figures 90) of the persons who are extracted.

Figure 5A:
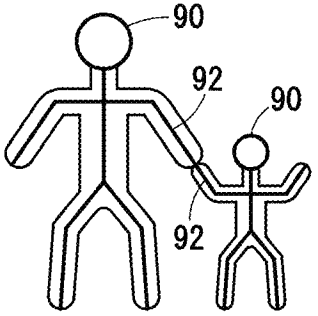
FIG. 5A is a schematic explanatory diagram showing a first contact example between schematic skeleton figures.

As shown in FIG. 5A, the skeleton figure generating unit 78*a* generates the schematic skeleton figures 90 by calculating principal human bones (the scull (cranial bones), the spine, the collarbone, the arm bones (upper arm bones, radial bones (radius) 92) and the leg bones (thigh bones, shinbones)), based on the shapes of the extracted persons. The bones that make up the schematic skeleton figures 90 may be simple line segments that extend in straight line shapes. In this case, locations where the line segments are bent and in contact with each other substantially coincide with human joints.

For example, the skeleton figure generating unit 78*a* extracts the shapes of the head and the waist, and forms a line segment for the spine that passes from the head to the center of the waist in the widthwise direction. Further, the skeleton figure generating unit 78*a* forms line segments passing through an average center from shapes of respective part such as the shoulders, the arms, and the legs of the human body, and which connect or intersect with the spine, thereby generating the schematic skeleton figure 90 for one person.

Moreover, the skeleton figure generating unit 78*a* may generate schematic skeleton figures 90 for all of the extracted living bodies, and if the user U is recognized by the user authentication unit 76, only the schematic skeleton figure 90 of the living body in close proximity to the user U may be generated. As will be discussed later, since the vehicle control device 10 determines the modes for the doors 14 based on the state of contact between the user U and the predetermined living body, it may be considered that living bodies who are distant from the user U have little or no relationship to the user U, and hence no problem arises even if the schematic skeleton figures 90 are not generated for such living bodies.

When two or more schematic skeleton figures 90 of living bodies are generated by the skeleton figure generating unit 78*a*, then based on the schematic skeleton figures 90, the contact estimation unit 78 estimates whether or not such living bodies are in contact with each other. For example, as shown in FIG. 5A, in the case that one end of a line segment constituting the radial bone 92 of the schematic skeleton figure 90 of one living body (an adult), and one end of a line segment constituting the radial bone 92 of the schematic skeleton figure 90 of another living body (a child) are in contact, it is estimated that such living bodies are in contact (i.e., holding hands) with each other.

Figure 5B:
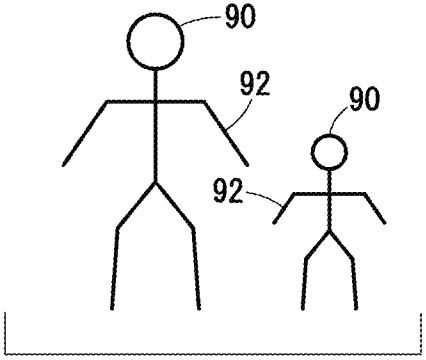
FIG. 5B is a schematic explanatory diagram showing a first non-contact example between schematic skeleton figures.

In contrast thereto, as shown in FIG. 5B, in the case that the schematic skeleton figure 90 of one living body (an adult) and the schematic skeleton figure 90 of another living body (a child) are separated, it is estimated that such living bodies are not in contact with each other. Moreover, since flesh portions of the living bodies are not reflected in the generated schematic skeleton figures 90, even in the case that the living bodies are actually in contact with each other, there is a possibility that parts on the schematic skeleton figures 90 may be slightly separated. Therefore, the contact estimation unit 78 may estimate a state of contact if one end of the radial bone 92 of one of the plurality of living bodies lies within a predetermined range (in close proximity) with respect to the other living body.

Figure 5C:
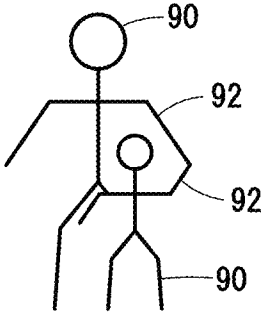
FIG. 5C is a schematic explanatory diagram showing a second contact example between other schematic skeleton figures.
Figure 5D:
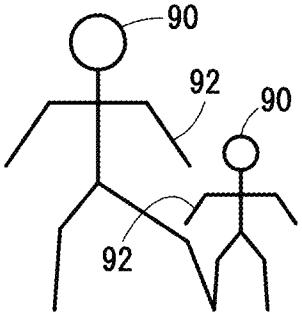
FIG. 5D is a schematic explanatory diagram showing a second non-contact example between other schematic skeleton figures.

For example, as shown in FIG. 5C, even if the schematic skeleton figure 90 of one living body and the schematic skeleton figure 90 of another living body overlap, in the case that the ends themselves of the line segments of the radial bones 92 intersect, it is estimated that such living bodies are in contact with each other. Conversely, as shown in FIG. 5D, even if the skeletal structure of the leg bone of the schematic skeleton figure 90 of one living body and the skeletal structure of the leg bone of the schematic skeleton figur 90 of another living body intersect one another, it is estimated that such living bodies are not in contact with each other. More specifically, as will be discussed later, in performing the opening and closing operations for the doors 14, it is important for the adult and the child to be holding hands. Therefore, it is desirable to estimate that the living bodies are in contact with each other, when ends of the line segments of the radial bones 92 maintain continuous contact with each other.

Figure 5E:
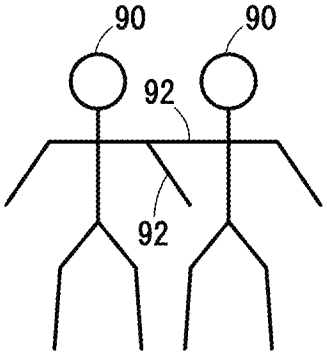
FIG. 5E is a schematic explanatory diagram showing a third contact example between other schematic skeleton figures.

Further still, the contact estimation unit 78 may estimate not only a state of contact between an adult and a child, but also a state of contact between adults themselves. For example, as shown in FIG. 5E, in the case that one end of the radial bone 92 of the schematic skeleton figure 90 of another living body is in contact with or sufficiently close in proximity with respect to a predetermined portion (the shoulder, the arm, or the like) of the schematic skeleton figure 90 of the one living body, it can be estimated that contact is taking place with a living body who is in need of assistance.

Figure 5F:
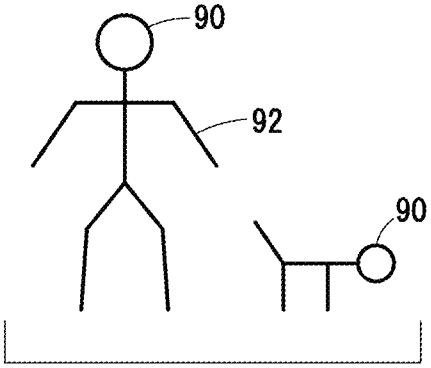
FIG. 5F is a schematic explanatory diagram showing a fourth contact example between other schematic skeleton figures.

Alternatively, the contact estimation unit 78 may be configured to estimate a state of contact between a person and another animal (a pet). For example, as shown in FIG. 5F, in the case that the schematic skeleton figure 90 of another living body (an animal) is continuously present at an end point where a line segment of the radial bone 92 of the schematic skeleton figure 90 of the one living body (a human) is extended, it can be estimated that the person and the animal are in contact with each other via a leash.

More specifically, the contact estimation unit 78 infers (registers) beforehand various situations in relation to states of contact between a plurality of the schematic skeleton figures 90, and may estimate states of contact therebetween by comparing the registered situations with the schematic skeleton figures 90 which have been generated. At this time, the contact estimation unit 78 may identify not only the state of contact and/or proximity between predetermined portions of the generated schematic skeleton figure 90, but may also calculate a degree of agreement (a correlation coefficient) between the registered patterns and the schematic skeleton figures 90, and the state of contact may be estimated based on the degree of agreement.

Returning to FIG. 4, the relationship estimation unit 68 of the image processing unit 60, based on the information obtained by the extracted information processing unit 66, estimates relationships between the objects extracted by the object extraction unit 64. More specifically, the relationship estimation unit 68 estimates the relationship between the user U and another living body, at a base point with a person (the user U of the vehicle 12) who has been authenticated as being a user.

For example, in the case that the relationship estimation unit 68 recognizes the user U (an adult) and a child who is in contact (holding hands) with the user U, the relationship estimation unit 68 estimates that the user U is present along with the child. At this time, the relationship estimation unit 68 may estimate that the child has a relationship with the user U if the child is in contact with the user U, even if information concerning the child has not been registered beforehand in the vehicle control device 10. Consequently, the vehicle control device 10 is capable of carrying out the control for opening the doors 14, even if the user U is not present along with his or her own child (even if the child is a child of a family member or the like).

In a similar manner, in the case that a living body (a person in need of assistance, an animal, or the like) which is in contact with the user U is recognized based on a state of contact estimated by the contact estimation unit 78, the relationship estimation unit 68 recognizes that the living body is related to the user U. On the other hand, in the case that information is received indicating that living bodies themselves other than the user U (for example, an adult and a child) are in contact with each other, the relationship estimation unit 68 recognizes that the other living bodies themselves are not related to the user U (are not persons who should be boarding the vehicle 12).

The mode determination processing unit 70 of the image processing unit 60 determines modes for the doors 14 of the vehicle 12 based on information concerning the contact or non-contact state between the user U and the predetermined living body (a child, a caregiver, an animal, or the like). Hereinafter, whether or not the user U and a child C are in contact with each other (holding hands) will be described as a typical example (see FIG. 1). As examples of modes for the doors 14 which are controlled by the vehicle control device 10 at times that the user U is boarding, there may be cited the following patterns (a) to (c).

(a) The locked doors 14 are unlocked, and further, the doors 14 are automatically opened.

(b) The doors 14 which are in a locked state are unlocked (the doors 14 continue to be closed).

(c) The doors 14 which are in a locked state continue to be locked.

Based on information from the relationship estimation unit 68, the mode determination processing unit 70 sets the above-described patterns (a) to (c) with respect to each of the doors 14 (the driver's seat door 20, the passenger seat door 21, the right rear seat door 22*a*, and the left rear seat door 22*b*) of the vehicle 12.

The mode determination processing unit 70 has retained therein beforehand map information 70*a* in which the relationships between the living bodies shown in FIG. 6 are collected, and determines the mode for each of the doors 14 based on the situations estimated by the relationship estimation unit 68. More specifically, in the case that user authentication is not performed by the user authentication unit 76, all of the doors 14 remain continuously locked even if living bodies are extracted from the captured image information captured by the image capturing units 30 (pattern (c): third mode). Conversely, in the case that user authentication is performed by the user authentication unit 76, all of the doors 14 are unlocked.

Furthermore, the mode determination processing unit 70 automatically opens the rear seat door 22 in addition to unlocking the rear seat door 22, in the case that the user is authenticated and the user U and the child C are holding hands (pattern (a): first mode). At this time, it is preferable that the rear seat door 22 for which opening is performed is the door 14 only on the side where the external environment sensors 32 determine that the user U and the child C are present. For example, in the case that the external environment sensor 32 which captures images on the right side of the vehicle 12 has recognized the child C who is holding hands with the user U, the right rear seat door 22*a* is opened whereas the left rear seat door 22*b* is not opened. Consequently, the child C can board the vehicle 12 in a smooth manner.

Conversely, the mode determination processing unit 70 only unlocks the rear seat door 22 while keeping the rear seat door 22 closed, in the case that the user is authenticated and the user U and the child C are not holding hands (pattern (b): second mode). Consequently, the user U or the child C himself performs the opening operation for the rear seat door 22, and it is possible to avoid a situation in which the child C collides with the rear seat door 22.

Moreover, the mode determination processing unit 70 may have a configuration in which, in the case that authentication of two or more users U is performed, the door 14 (the passenger seat door 21 or the left rear seat door 22*b*) on an opposite side from the installation position (for example, the right side) of the external environment sensor 32 that has captured an image of the user U is automatically opened. At this time, a configuration may be provided in which, in the case that at least one of the two or more users U is in contact (holding hands) with a living body, the left rear seat door 22*b* is opened in addition to the right rear seat door 22*a*.

The door control unit 80 of the vehicle control device 10 issues instructions concerning the operation content for the doors 14 with respect to the door operating system 50, based on the determination of the modes of the doors 14 made by the mode determination processing unit 70. A lock command control unit 82 that commands locking and unlocking of the doors 14, and a door opening and closing command control unit 84 that commands the opening operation and the closing operation for each of the doors 14 are provided inside the door control unit 80.

As has been described above, in order for the mode determination processing unit 70 to determine the modes for each of the doors 14, the lock command control unit 82 and the door opening and closing command control unit 84 also output to the door operating system 50 command information for the respective doors 14 based on the mode determination result. In addition, based on reception of the command information from the door control unit 80, the door operating system 50 performs the locking and unlocking operation and the opening and closing operation for each of the doors 14.

The vehicle control device 10 according to the first embodiment is basically configured in the manner described above. Next, a description will be given concerning operations thereof.

Figure 7:
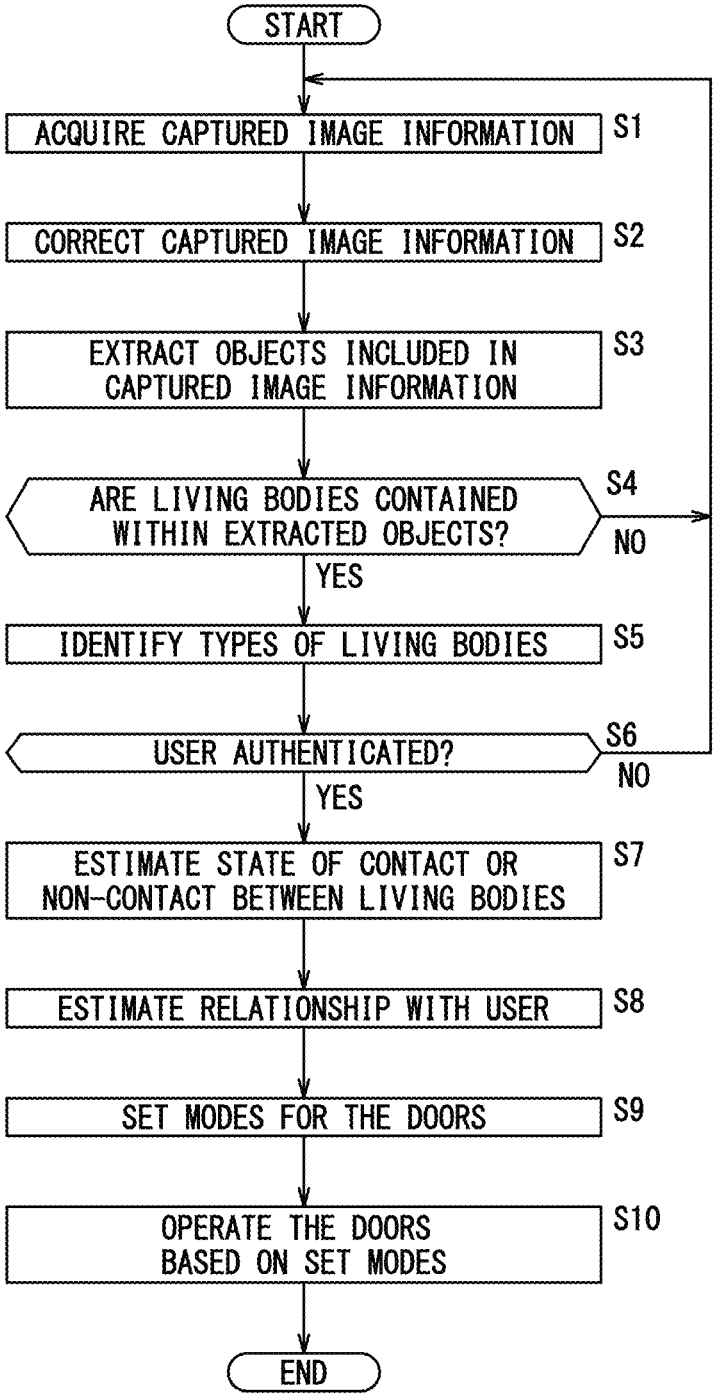
FIG. 7 is a flowchart showing an example of a method of operating an opening and closing body performed by the vehicle control device according to the first embodiment.

As has been described above, the vehicle control device 10 monitors the situation of the external environment while the vehicle 12 is in a stopped state, and performs controls to switch the modes for the doors 14 of the vehicle 12 when the user U boards the vehicle 12. For example, as shown in FIG. 7, the vehicle control device 10 performs control processing in accordance with a flowchart for the method of operating an opening and closing body.

More specifically, in step S1, the image processing unit 60 of the control equipment 40 transmits a control command from the control equipment 40 to the image capturing units 30 via the input/output interface 42, and acquires (receives) the captured image information captured by the image capturing units 30. In addition, the control equipment 40 temporarily stores in the RAM 46*b* the captured image information continuously over time, and sequentially processes the captured image information which is stored.

In carrying out the image processing of the captured image information, the captured image information processing unit 62 corrects the captured image information so as to enable objects to be easily extracted (step S2), and thereafter, the object extraction unit 64 extracts the objects included within the captured image information (step S3). In addition, the object extraction unit 64 determines whether or not dynamic objects (living bodies) are contained within the extracted objects (step S4), and in the case that dynamic objects are contained therein, the process proceeds to step S5, whereas in the case that dynamic objects are not contained therein, the process returns to step S1 and is repeated.

In step S5, the type identification unit 72 of the extracted information processing unit 66 identifies (recognizes) the types of the extracted living bodies (an adult, a child C, etc.). Further, the user authentication unit 76 of the extracted information processing unit 66 implements user authentication for confirming whether or not the user U of the vehicle 12 is present among the extracted living bodies (step S6). As has been noted above, concerning user authentication, feature amounts of the living bodies extracted from the captured image information are compared with registered feature amounts of the user U to thereby determine whether or not the user U is present. In the case that the user U is not authenticated, the process returns to step S1, whereas in the case that the user U is authenticated, the process proceeds to step S7.

Furthermore, the contact estimation unit 78 of the extracted information processing unit 66 estimates the state of contact or non-contact between the extracted living bodies (step S7).

The processing order of steps S4 to S7 is not particularly limited, or alternatively, such processing may be carried out in parallel. In the case of performing sequential processing, the extracted information processing unit 66 may use the information that was processed first, and thereby limit the content to be processed subsequently. For example, at the time of user authentication, in the case that the types of the living bodies are estimated first, processing can be made more efficient by carrying out user authentication only with respect to a specified adult. Further, for example, at the time of estimating contact between the living bodies themselves, in the case that user authentication is carried out first, only living bodies for which there is a possibility of being in contact with the user U may be subjected to processing (generation of the schematic skeleton figures 90, estimation of contact, etc.).

Alternatively, since the vehicle control device 10 continues to keep the doors 14 of the vehicle 12 locked under a situation in which user authentication has not been performed, the vehicle control device 10 may be configured to perform user authentication after having extracted the objects. Consequently, the processing load can be significantly reduced by not carrying out estimation of the types of the living bodies and estimation of contact between the living bodies until user authentication has been performed.

In step S8, based on the processing information processed by the extracted information processing unit 66, in the case that a living body exists who is in contact with the user U, the relationship estimation unit 68 of the image processing unit 60 estimates the relationship of the living body to the user U. The vehicle control device 10 is capable of setting the mode for each of the doors 14 of the vehicle 12 in greater detail, by estimating the relationship between the user U and the other living body on the basis of the extracted information.

The mode determination processing unit 70 of the image processing unit 60 refers to the map information 70*a* shown in FIG. 6, and sets the mode for each of the doors 14 based on the relationship estimated by the relationship estimation unit 68 (step S9). In addition, when the set modes for the doors 14 are output from the image processing unit 60 to the door control unit 80, the door control unit 80 operates each of the doors 14 of the vehicle 12 based on the set modes (step S10).

For example, the vehicle control device 10 unlocks and automatically opens the door 14 for the rear seat 18 in the case that the user U and the child C are holding hands. Consequently, the child C can be easily allowed to board the vehicle and sit on the rear seat 18. Further, for example, in the case that the user U and the child C are not holding hands, the vehicle control device 10 only unlocks the rear seat door 22. Consequently, the child C recognizes that the rear seat door 22 is not opened unless he or she is holding hands with the user U, and interference with the rear seat door 22 can be suppressed.

The present invention is not limited to the above-described embodiment, and various modifications can be made thereto in accordance with the essence and gist of the invention. For example, in recognizing the state of contact or non-contact between the user U and the predetermined living body, concerning the modes for the doors 14, the vehicle control device 10 may include modes that differ from those of the above-described embodiment. As one example thereof, when it is recognized that the user U and the child C are not in contact with each other, the rear seat door 22 may continue to be locked (the above-described pattern (c)). In addition, when it is recognized that the user U and the child C have come into contact with each other, unlocking and opening of the rear seat door 22 may be carried out (the above-described pattern (a)), or alternatively, only unlocking of the rear seat door 22 may be carried out (the above-described pattern (b)). In essence, the vehicle control device 10 is capable of selecting appropriate modes for the respective doors 14, depending on the positions and states at a time of having recognized the user U and the predetermined living body, and the positions of the respective doors 14 (the driver's seat door 20, the passenger seat door 21, the right rear seat door 22*a*, and the left rear seat door 22*b*).

After unlocking the rear seat doors 22 while continuing to keep them closed on the basis of the fact that the user U and the child C are not in contact with each other, if it has been recognized that the user U and the child C are in contact with each other, then the vehicle control device 10 may open the rear seat doors 22. More specifically, the vehicle control device 10 uses recognition of the contact between the user U and the child C as a trigger for opening the doors 14, and if the doors 14 have been unlocked (if the user has been authenticated), the timing at which the doors 14 are opened may deviate from the timing at which the modes are initially determined.

Figure 4:
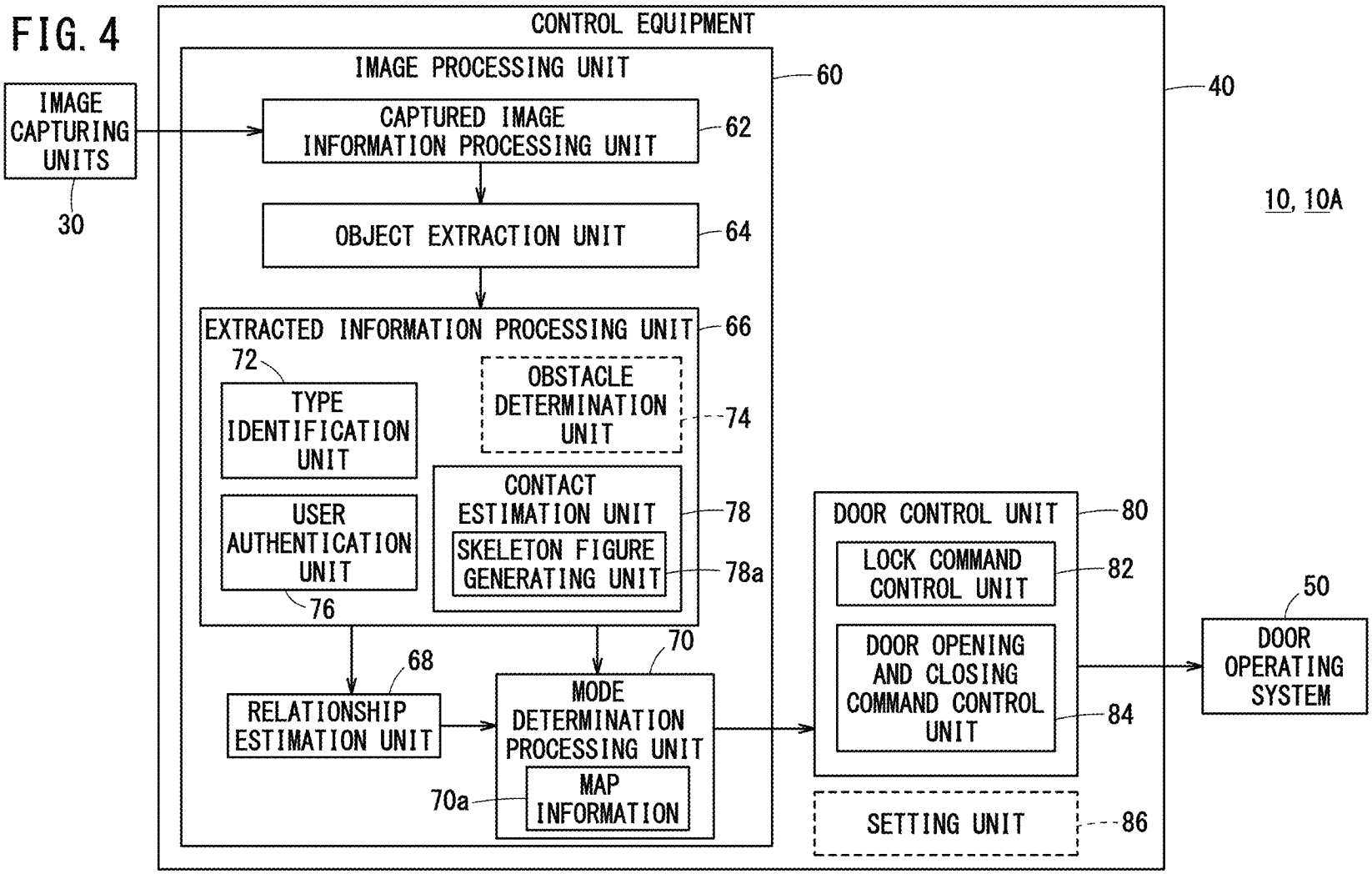
FIG. 4 is a block diagram showing a software configuration of control equipment.

Further, for example, as shown by the dash line in FIG. 4, the vehicle control device 10 may be configured to be equipped with a setting unit 86 that enables the door 14 that is opened to be set by the user U, in the case that the user U is in contact with a predetermined living body (a child C, a caregiver, an animal, or the like). The setting unit 86 displays setting information on a non-illustrated display unit (display) of the vehicle 12, and stores the door 14 to be opened for the predetermined living body that is set by the user U. Based on the set content, the mode determination processing unit 70, for example, opens the door 14 that was set, even if contact between the user U and the child C is recognized by the external environment sensors 32 on an opposite side from the set door 14. In accordance with this feature, the vehicle control device 10 is capable of opening a door 14 positioned in close proximity to where a child seat is located, and convenience of the user U can be enhanced.

Furthermore, the vehicle control device 10 may measure the time in order to estimate contact or non-contact between the user U and the predetermined living body, and preferably sets, as a condition for determining contact between the living bodies, that such contact has taken place for greater than or equal to a predetermined time period (for example, several seconds). Consequently, it is possible to reduce noise of the objects extracted from the captured image information, and to prevent the doors 14 from opening based merely on momentary contact between the user U and another living body.

In the above-described configuration, a configuration may be further provided in which, in the case it is determined that the user U and another adult remain in close proximity to each other for a predetermined time period, the vehicle control device 10 determines that a relationship exists between the user U and the other adult, and the doors 14 are opened.

Further, regarding the state of contact between the schematic skeleton figures 90 of the user U and the other living body, the vehicle control device 10 may set the doors to open in the case that the user U and the other living body are in a special posture (hugging, carrying a child in a piggyback manner, or the like). In the case that two children C are recognized in relation to the user U, a configuration may be provided in which the doors 14 are opened based on contact between the user U and each of the two children C, or a configuration may be provided in which the doors 14 are opened based on contact between the user U and only one of the children C.

Still further, in the case of a public assistance vehicle (welfare vehicle) or the like configured to board a wheelchair thereon from the back door 23, the vehicle 12 may be configured to unlock and open the back door 23 when a state of contact is recognized between the user U and a wheelchair user.

Second Embodiment

Figure 8:
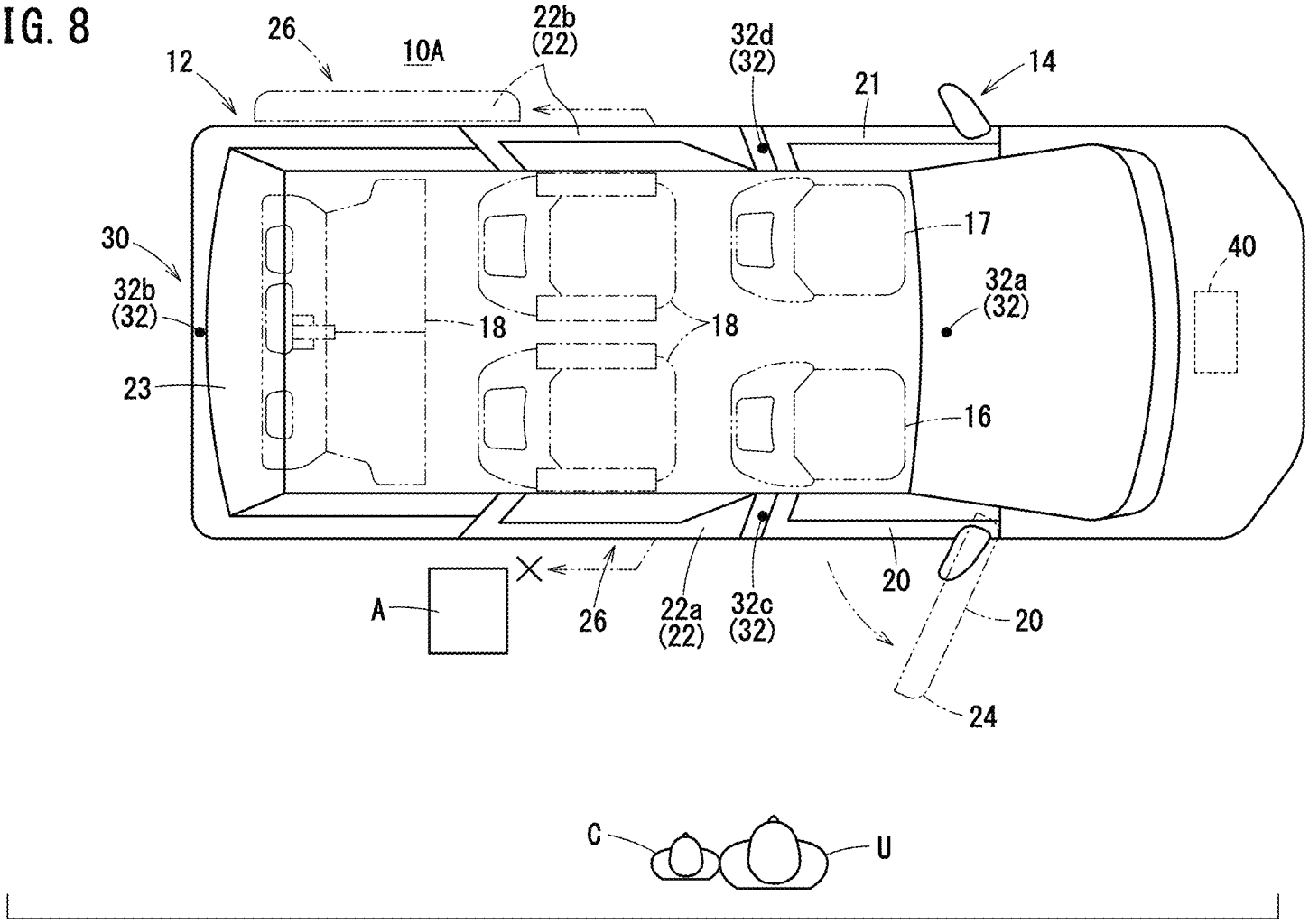
FIG. 8 is a plan view showing the operation of a vehicle door in which a vehicle control device according to a second embodiment of the present invention is provided.

As shown in FIG. 8, the vehicle control device 10A according to the second embodiment differs from the vehicle control device 10 described above, in that, when controlling the opening and closing operations of the doors 14, the vehicle control device 10A is configured to determine whether an obstacle A is present that hinders opening of the doors 14. Consequently, the vehicle control device 10A is capable of further setting the modes for the doors 14 in a more detailed manner depending on whether or not there is an obstacle A in close proximity to the doors 14. Moreover, in FIG. 8, although a configuration is illustrated in which the rear seat doors 22 are sliding doors 26, the determination of the obstacle A is more preferably carried out in particular when the rear seat doors 22 are hinged doors 24.

For example, the vehicle control device 10A can determine the obstacle A based on the captured image information of the image capturing units 30. For this purpose, as shown by the dashed line in FIG. 4, an obstacle determination unit 74 is provided in the extracted information processing unit 66. Based on an extracted stationary object, the obstacle determination unit 74 determines whether or not the stationary object will act as an obstacle A for which there is a possibility of coming into contact with the doors 14 when the doors 14 of the vehicle 12 are opened. For example, the obstacle determination unit 74 identifies the type of the obstacle A from feature amounts (the shape, shadows) of the stationary object, and calculates the distance to the doors 14 based on the size of the identified obstacle A. Alternatively, in the case that the external environment sensors 32 utilize a plurality of cameras or radar devices, the distance can be calculated based on the captured image information.

Further, the obstacle determination unit 74 preferably determines not only a stationary object, but also determines as being such an obstacle A, a pedestrian or a traveling vehicle such as a bicycle or the like for which there is a possibility of a collision when the doors 14 are automatically opened. Pedestrians and traveling vehicles that may affect opening of the doors 14 can be appropriately determined by calculating vectors (direction, velocity, etc.) of dynamic objects detected based on captured image information that changes over time.

Figure 9:
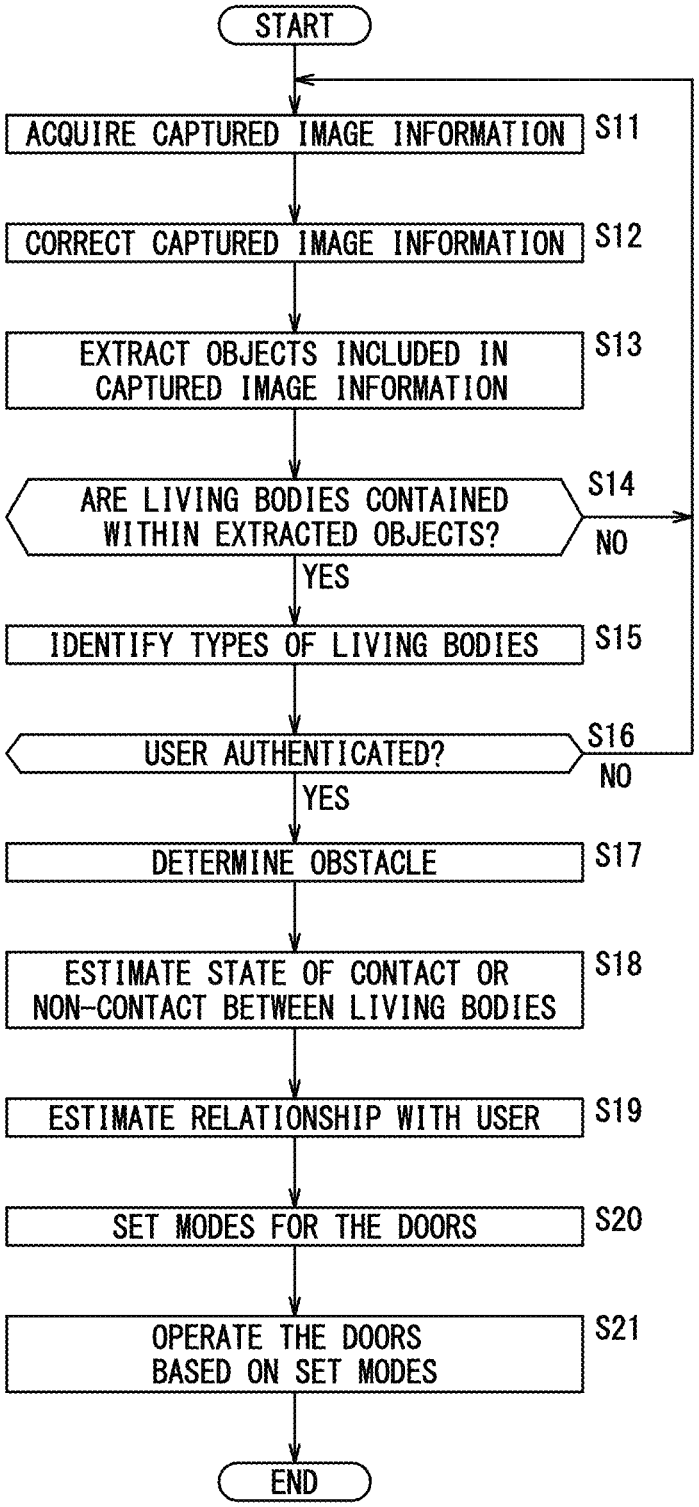
FIG. 9 is a flowchart showing an example of a method of operating an opening and closing body performed by the vehicle control device according to the second embodiment.

Hereinafter, a description will be given with reference to FIG. 9 concerning a process flow for a case in which the vehicle control device 10A determines the presence of an obstacle A. In steps S11 to S16, the vehicle control device 10A performs the same processes as those of the aforementioned steps S1 to S6 of the vehicle control device 10.

Then, in step S17, the obstacle determination unit 74 of the extracted information processing unit 66 determines, in relation to the extracted objects, whether or not an obstacle A exists that acts as an obstacle hindering opening of the doors 14. Further, the contact estimation unit 78 estimates the state of contact or non-contact between the extracted living bodies (step S18). The processing order of steps S14 to S18 is not particularly limited, or alternatively, such processing may be carried out in parallel. For example, the vehicle control device 10A initially determines the presence or absence of the obstacle A, and in the case that the obstacle A is determined to exist, by the vehicle control device 10A prohibiting the opening operation of the doors 14, there is no particular need to subsequently carry out a process of estimating contact between the living bodies. In this case, the vehicle control device 10A may be configured to notify the user that the doors 14 cannot be opened at the time of user authentication.

In addition, in the case that a living body is present who is in contact with the user U, the image processing unit 60 estimates the relationship with the user U by the relationship estimation unit 68 (step S19), and further, the mode determination processing unit 70 sets the mode for each of the doors 14 based on the estimated relationship (step S20). When the set modes for the doors 14 are output from the image processing unit 60 to the door control unit 80, the door control unit 80 operates each of the doors 14 of the vehicle 12 based on the set modes (step S21).

In this instance, in the case that the vehicle control device 10A has determined the presence of the obstacle A, even if the user U and the child C are holding hands, only unlocking of the rear seat door 22 is performed (or alternatively, the locked state thereof is continued). Consequently, the vehicle control device 10 is capable of preventing the doors 14 from coming into contact with the obstacle A. Moreover, when the user U and the child C are holding hands, by unlocking and opening a door 14 positioned near a sensor that has not captured an image of the obstacle A, the vehicle control device 10A may promote boarding of the vehicle from that door 14 (see FIG. 8).

Technical concepts and effects which are capable of being grasped from the above-described embodiments are noted below.

One aspect of the present invention is characterized by the vehicle control device 10, which is equipped with the image capturing units 30 provided in the vehicle 12 and which capture images of the external environment of the vehicle 12, the control unit (control equipment 40) that extracts at least one living body from image information captured by the image capturing units 30 and performs processing, and the opening and closing body operating unit (door operating system 50) which, under the control of the control unit, is capable of switching the opening and closing body (door 14) of the vehicle 12 from a locked state to an unlocked state, together with being capable of executing an opening operation of the opening and closing body, wherein the control unit includes the type identification unit 72 that identifies (recognizes) a type of the living body that was extracted, and in the case that the user U of the vehicle 12 is included among a plurality of the living bodies that were extracted, and it is estimated that a predetermined type of living body that was identified by the type identification unit 72 is in contact with the user U, the control unit causes the opening and closing body to be operated in the first mode, whereas, in the case that the user U is included among the plurality of living bodies that were extracted, and it is estimated that the predetermined type of living body that was identified by the type identification unit 72 is not in contact with the user U, the control unit causes the opening and closing body to be operated in the second mode that differs from the first mode.

In the above-described vehicle control device 10, both convenience and safety can be ensured at the time of boarding, by estimating contact or non-contact between the user U of the vehicle 12 and the predetermined living body, and switching the opening and closing body (door 14) to the appropriate mode, based on the captured image information. More specifically, if the predetermined living body is in contact with the user U, safety is achieved, and for example, the vehicle control device 10 opens, as the first mode, the opening and closing body without being hindered and thereby facilitates boarding, and thus convenience of the user U can be enhanced. On the other hand, since it can be said that safety cannot be achieved if the predetermined living body is not in contact with the user U, for example, the vehicle control device 10 maintains, as the second mode, the opening and closing body in a closed state, and thus it is possible to prevent movement of the predetermined living body, and to reduce the risk of coming into contact with the vehicle 12 or the like.

Further, the first mode is a mode in which the opening and closing body (door 14) is unlocked, and further, the opening and closing body is made to perform the opening operation, and the second mode is a mode in which the opening and closing body is unlocked, and the opening and closing body remains closed while capable of being opened. In accordance with this feature, by keeping the opening and closing body in an unlocked state at times when the safety of other living bodies cannot be achieved, the vehicle control device 10 can safely allow the opening and closing body to be opened by an operation of the user U.

Further, from among a plurality of the opening and closing bodies (doors 14) provided on the vehicle 12, the opening and closing body that is operated in the first mode or the second mode is the rear seat door 22 adjacent to the rear seat 18 of the vehicle 12. In accordance with this feature, the vehicle control device 10 can easily allow the predetermined living body to board the vehicle on the rear seat 18 while ensuring the safety of the predetermined living body.

Further, after the opening and closing body (door 14) has been set in the second mode, the control unit (control equipment 40) changes the opening and closing body to the first mode, in the case it is recognized that the user U and the predetermined type of living body have come into contact with each other. In accordance with this feature, in the vehicle control device 10, even after implementation of the second mode, since the opening and closing body becomes set in the first mode if the user U and the predetermined living body come into contact with each other, convenience can be further enhanced.

Further, the image capturing units 30 include the external environment sensors 32 which are installed respectively on both sides in the lateral (widthwise) direction of the vehicle 12, and the control unit (control equipment 40) causes the opening and closing body (door 14), which is on the same side as one of the external environment sensor 32 that has captured an image of the user U, to be operated in the first mode or the second mode. In accordance with such features, the vehicle control device 10 can smoothly guide the predetermined living body into the vehicle compartment interior from the side where the image was captured.

Further, in the case of having recognized the user U, the control unit (control equipment 40) switches, from among a plurality of the opening and closing bodies (doors 14) provided on the vehicle 12, the driver's seat door 20 adjacent to the driver's seat 16 from the locked state into the unlocked state, and further causes the driver's seat door 20 to perform the opening operation. In accordance with this feature, the vehicle control device 10 can easily allow the user U to board the vehicle on the driver's seat 16.

Further, the control unit (control equipment 40) generates the schematic skeleton figure (schematic skeleton figure 90) of the living body that was extracted from the captured image information, and estimates whether or not the user U and the predetermined living body are in contact with each other, based on the generated schematic skeleton figure of the user U, and the generated schematic skeleton figure of the predetermined type of living body. In accordance with this feature, the vehicle control device 10 can easily and accurately estimate the state of contact between the user U and the predetermined living body.

Further, the control unit (control equipment 40) estimates that the user U and another living body are in contact with each other, based on a skeleton figure of an arm of either one of the schematic skeleton figure (schematic skeleton figures 90) of the user U and the schematic skeleton figure of the predetermined type of living body being in contact with the other skeleton figure. In accordance with this feature, the vehicle control device 10 is capable of more accurately estimating that the safety of the predetermined living body is ensured.

Further, from among a plurality of the opening and closing bodies (doors 14) provided on the vehicle 12, the control unit (control equipment 40) causes the opening and closing body that is operated in the first mode or the second mode, to be capable of being set by the user U. In accordance with this feature, the vehicle control device 10 enables an opening and closing body positioned in close proximity to a location where a child seat or the like is installed, to be set so as to be capable of opening and closing, and convenience can be further enhanced.

Further, another aspect of the present invention is characterized by the method of operating an opening and closing body by the vehicle control device 10, which is equipped with the image capturing units 30 provided in the vehicle 12 and which capture images of the external environment of the vehicle 12, the control unit (control equipment 40) that extracts and performs processing on at least one living body from image information captured by the image capturing units 30, and the opening and closing body operating unit (door operating system 50) which, under the control of the control unit, is capable of switching the opening and closing body (door 14) of the vehicle 12 from a locked state to an unlocked state, together with being capable of executing an opening operation of the opening and closing body, the method including authenticating the user U of the vehicle 12 by the control unit, unlocking the opening and closing body by the opening and closing body operating unit in the case that the user U is authenticated, estimating contact between the user U and a predetermined type of living body by the control unit, based on the image information captured by the image capturing units 30, and causing the opening and closing body operating unit to open the unlocked opening and closing body in the case it is estimated that the user U and the predetermined type of living body are in contact with each other. In accordance with such features, the vehicle control device 10 is capable of estimating contact between the user U of the vehicle 12 and the predetermined living body based on the captured image information, and can open the opening and closing body, whereby both convenience and safety can be ensured at the time of boarding.

The present invention is not particularly limited to the embodiment described above, and various modifications are possible without departing from the essence and gist of the present invention.

What is claimed is:

1. A vehicle control device, comprising:

an image capturing unit provided in a vehicle and configured to capture an image of an external environment of the vehicle;

a control unit including at least one processor configured to extract at least one living body from image information captured by the image capturing unit and perform processing; and an opening and closing body operating unit configured to, under control of the at least one processor, switch an opening and closing body of the vehicle from a locked state to an unlocked state and execute an opening operation of the opening and closing body;

wherein the at least one processor identifies a type of the living body that was extracted; and in a first mode a user of the vehicle is included among a plurality of the living bodies that were extracted and the at least one processor estimates that a predetermined type of living body that was identified is in contact with the user, the at least one processor causes the opening and closing body to be operated in the first mode; and in a second mode the user is included among the plurality of living bodies that were extracted and the at least one processor estimates that the predetermined type of living body that was identified is not in contact with the user, the at least one processor causes the opening and closing body to be operated in the second mode that differs from the first mode.

2. The vehicle control device according to claim 1, wherein:

in the first mode, the opening and closing body is unlocked, and further, the opening and closing body is made to perform the opening operation; and in the second mode, the opening and closing body is unlocked, and the opening and closing body remains closed while being openable.

3. The vehicle control device according to claim 2, wherein, from among a plurality of the opening and closing bodies provided on the vehicle, the opening and closing body that is operated in the first mode or the second mode is a seat adjacent to a rear seat of the vehicle.

4. The vehicle control device according to claim 2, wherein, after the opening and closing body has been set in the second mode, the at least one processor changes the opening and closing body to the first mode, in a case it is recognized that the user and the predetermined type of living body have come into contact with each other.

5. The vehicle control device according to claim 1, wherein:

the image capturing unit includes external environment sensors installed respectively on both sides in a lateral direction of the vehicle; and the at least one processor causes the opening and closing body that is on a same side as one of the external environment sensors that has captured an image of the user, to be operated in the first mode or the second mode.

6. The vehicle control device according to claim 1, wherein, when the user is recognized, the at least one processor switches, from among a plurality of the opening and closing bodies provided on the vehicle, a door adjacent to a driver's seat from a locked state into an unlocked state, and further causes the door to perform the opening operation.

7. The vehicle control device according to claim 1, wherein the at least one processor generates a schematic skeleton figure of the living body that was extracted from the captured image information, and estimates whether or not the user and the predetermined living body are in contact with each other, based on a generated schematic skeleton figure of the user, and a generated schematic skeleton figure of the predetermined type of living body.

8. The vehicle control device according to claim 7, wherein the at least one processor estimates that the user and the predetermined type of living body are in contact with each other, based on a skeleton figure of an arm of either one of the schematic skeleton figure of the user and the schematic skeleton figure of the predetermined type of living body being in contact with another skeleton figure.

9. The vehicle control device according to claim 1, wherein, from among a plurality of the opening and closing bodies provided on the vehicle, the at least one processor causes the opening and closing body that is operated in the first mode or the second mode, to be settable by the user.

10. A method of operating an opening and closing body by a vehicle control device, wherein the vehicle control device includes:

an image capturing unit provided in a vehicle and configured to capture an image of an external environment of the vehicle;

a control unit including at least one processor configured to extract at least one living body from image information captured by the image capturing unit and perform processing; and an opening and closing body operating unit configured to, under control of the at least one processor, switch an opening and closing body of the vehicle from a locked state to an unlocked state and execute an opening operation of the opening and closing body;

the method comprising: with the at least one processor, unlocking the opening and closing body by the opening and closing body operating unit in a case that a user of the vehicle is authenticated;

estimating contact between the user and a predetermined type of living body, based on image information captured by the image capturing unit; and causing the opening and closing body operating unit to open the unlocked opening and closing body, in a case that the at least one processor estimates that the user and the predetermined type of living body are in contact with each other.

* * * * *